United States Patent [19]

Garner et al.

[11] 4,429,519

[45] Feb. 7, 1984

[54] FORMING CABLE CORE UNITS

[75] Inventors: John N. Garner, Kingston; Jean M. Roberge, Pointe Claire; Oleg Axiuk, Pinecourt, all of Canada

[73] Assignee: Northern Telecom Limited, Montreal, Canada

[21] Appl. No.: 413,175

[22] Filed: Aug. 30, 1982

[51] Int. Cl.[3] ..... H01B 13/04

[52] U.S. Cl. ..... 57/293; 57/18; 57/294; 57/314

[58] Field of Search ..... 57/3, 6, 9, 13, 14, 57/18, 293, 294, 332, 314, 344–349

[56] References Cited

U.S. PATENT DOCUMENTS

| | | | |
|---|---|---|---|
| 3,847,190 | 11/1974 | Forester | 57/293 X |
| 3,910,022 | 10/1975 | Reed | 57/293 |
| 4,325,214 | 4/1982 | Zuber | 57/293 |
| 4,359,860 | 11/1982 | Schleese et al. | 57/293 |

*Primary Examiner*—John Petrakes
*Attorney, Agent, or Firm*—R. J. Austin

[57] ABSTRACT

Cable core unit forming apparatus having a plurality of wire guide means, each for stranding wires together. The guide means are laterally spaced and each extends along a longitudinal axis to be non-rotatable about the axis at its upstream end. It is rotationally flexible to be torsionally twisted by rotatable twisting means at its downstream end. Each guide means are disposed at one of two or more twisting stations. Feedpaths for wires from other twisting stations converge to a stranding station for the core unit. Wire separation tubes prevent the wires from stranding into pairs until immediately before the stranding station. Each separation tube is rotated about its axis which is maintained curved to follow one of the converging paths and the tube is flexible to enable its curved axis position to be maintained during rotation.

10 Claims, 6 Drawing Figures

FORMING CABLE CORE UNITS

This invention relates to the forming of cable core units.

It is known that the stranding of wires together to form a wire unit offers physical and electrical advantages when the wires are individually insulated conductors as used in communications or other electrical systems. For example, the stranding of pairs or units of wires as used in telephone systems improves electrical characteristics such as reducing cross-talk.

Conventionally, to continuously strand wires together in the same direction requires a heavy, rotatable construction as the wire spools for feeding wire into the apparatus must also revolve about the machine axis. The excessive weight of the construction limits the operational speed. In order to avoid the rotation of the spools, a periodically reversing stranding operation is performed upon the wires and, as it is desirable to strand long lengths of wires in each direction, accumulators become necessary.

In order to overcome problems with known stranding apparatus, simpler apparatus has been devised to give a periodic reverse stranding operation. This simpler apparatus as described in U.S. Pat. No. 3,910,022 granted Oct. 7, 1975 in the name of Phillip John Reed and entitled "Apparatus for Stranding Wires" involves the use of a tubular member, one end of which is held stationary and the other torsionally twisted first in one direction and then the other around its longitudinal axis. Dividers positioned along the member divide the tube passage into separate paths for wires passing down the member. A twisting means at the downstream end of the tubular member, twists the member by rotating the downstream end of the member for a predetermined number of revolutions, first in one direction and then the other, to torsionally twist the member in reversing manner. A twist is imposed upon each wire by the twisting means and this twist causes the wires to strand together along their lengths as the wires emerge from the twisting means.

In U.S. Pat. No. 4,325,214 granted Apr. 20, 1982, in the name of Bretislav Pavel Zuber, and entitled "Apparatus for Stranding Wire", the tubular member is replaced by an elongate member which is held stationary at an upstream end and is rotatable at its downstream end for twisting it. The elongate member has a plurality of wire guiding elements extending radially outwards from it, each element having wire guiding holes whereby the wires are threaded through the holes from guiding element to guiding element while being located outwards from the elongate member.

In another patent application Ser. No. 413,179 in the names of John Nicholas Garner, Jean Marc Roberge and filed concurrently with this present application and entitled "Stranding Wires", there is described a further alternative to the construction covered by U.S. Pat. No. 3,910,022 and 4,325,214. In the application entitled "Stranding Wires," apparatus for stranding wires comprises at least two tubes each defining a passage for wire, the tubes being rotatably flexible about a common axis to torsionally twist the tubes together around the axis to enable each of the wires to be given a twist by the twisting means while the tubes prevent the wires from twisting together. The tubes are prevented from moving towards or away from each other during the twisting operation and a resilient means is used at one end of the tubes to place the tubes continuously in tension and to allow for end movement of the tubes as the tubes change in effective length during each twisting and untwisting operation. The wires strand together to form a wire unit immediately they pass downstream from the twisting means.

While the stranding apparatus as described in each of the patents referred to above successfully overcome the problems associated with the use of heavy rotatable machinery, no apparatus has yet been devised for simultaneously forming a plurality of wire units each formed in a manner disclosed in the above patents and application, and then for subsequently combining these wire units in the form of a cable core unit.

Accordingly, the present invention provides apparatus for forming a cable core unit from a plurality of wire units, each of at least two stranded together wires, comprising a plurality of wire guide means, each for the wires of one of the units, each guide means having a longitudinal axis extending in a wire pass direction, being rotationally flexible, and defining individual feedpaths for the two wires of its unit to maintain the wires separate as they proceed to one of at least a first and second twisting stations disposed downstream of the guide means with the second twisting station downstream of the first station; each guide means terminating at its respective station in a twisting means which is rotatable at its station around the feedpaths of the guide means to effect a rotational twist to the guide means and thus of the feedpaths around the axis, rotating means to rotate the twisting means in each station and effect rotational twisting of each guide means and its feedpaths for a plurality of revolutions about its axis alternately in one direction and then in the other to introduce and impose an alternating twist in the wires and hold the wires separate as they move towards the twisting means; a stranding station downstream of the twisting stations with at least a section of the feedpaths for wires for some wire units being curved and of fixed orientation between each twisting station and the stranding station to cause convergence of the feedpaths of the wires of each unit with the wires of other units as they approach the stranding station and to enable the wire units to combine together to form the cable core units; and separation tube means to prevent the wires for each wire unit from stranding together before they reach the stranding station, said separation tube means being rotatable with the twisting means and extending in curved configuration along the curved feedpath sections, with flexibility to enable the tube means to be maintained in its curved configuration along said fixed path section during rotation of the tube means in said alternating directions and with torsional rigidity to avoid build-up and retention of twist.

With the above apparatus and with the guide means terminating at different twisting stations, it has been found that the width across the apparatus, i.e. transversely to the feedpaths, is reduced to a minimum and this is dictated primarily by the permissible closeness of the guide means. In a preferred arrangement, the guide is of the construction described in the patent application referred to above entitled "Stranding Wires" in the names of John Nicholas Garner and Jean Marc Roberge. In that construction, a guide means comprises at least two tubes which define a passage for the wires for each wire unit. Lateral vibration of the tubes during twisting is minimal so as not to be a factor in determining the closeness together of the guide means in apparatus according to the present invention. Twisting means is necessarily of larger dimensions in a lateral direction to the feedpaths than the guide means. The disposition of the twisting means in the different twisting stations results in a need for less width across the apparatus than if the twisting means were all located at one station. Also, in grouping the twisting means in this way, it simplifies the driving of all the twisting means at each station by common driving means and this is an important consideration. In a practical construction, it is shown that where a cable core unit is to be made having twenty-five wire units each of a stranded pair of wires, then if three twisting stations are employed, spaced downstream of the feedpaths one after another, then the twisting means may be placed at each of these stations to provide an overall width across the apparatus, i.e. transversely to the feedpaths, of around 20 inches. In such an arrangement, the preferred construction has frames for holding the twisting means in position and the wire guide means extend to the twisting means along paths which are disposed around a common axis of the apparatus. Some of the guide means and thus the twisting means are disposed outwardly of the common axis from others. In a preferred arrangement, the outwardly disposed twisting means are located around one pitch circle and inwardly disposed twisting means are disposed around another pitch circle or pitch circles.

One embodiment of the invention will now be described by way of example with reference to the accompanying drawings in which.

Figure 1:
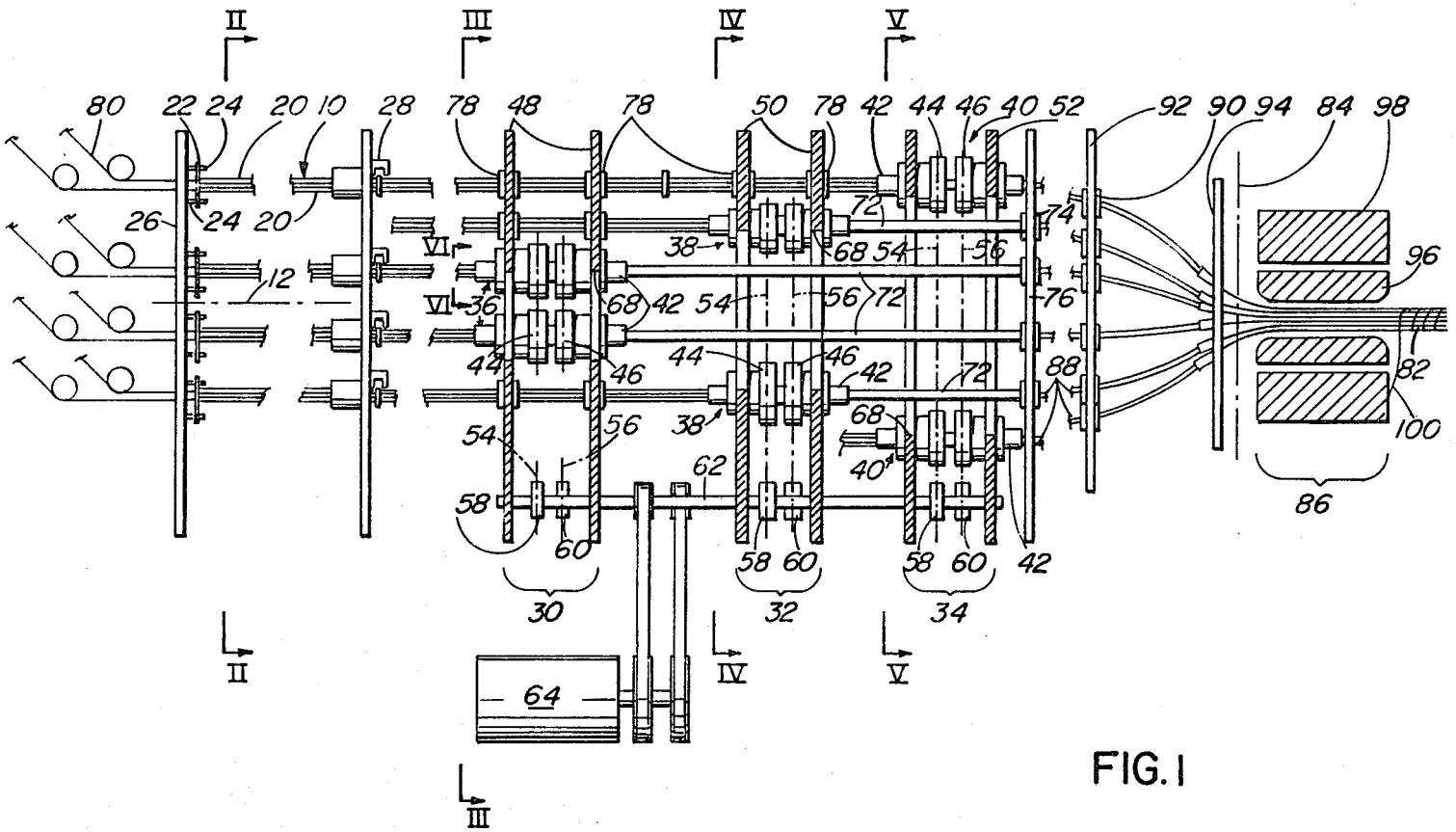
FIG. 1 is a side elevational view, partly in cross-section, of apparatus for forming insulated conductors into stranded pairs or wire units and for forming a cable core unit from the stranded pairs.

The apparatus shown in the drawings is an apparatus for the manufacture of a cable core unit from twenty-five wire units, i.e. stranded pairs of insulated electrical conductors (referred to as "wires" in this specification). The core unit may be intended to form a complete cable core, or the core may be made from a plurality of such units.

Figures 2, 3, 4:
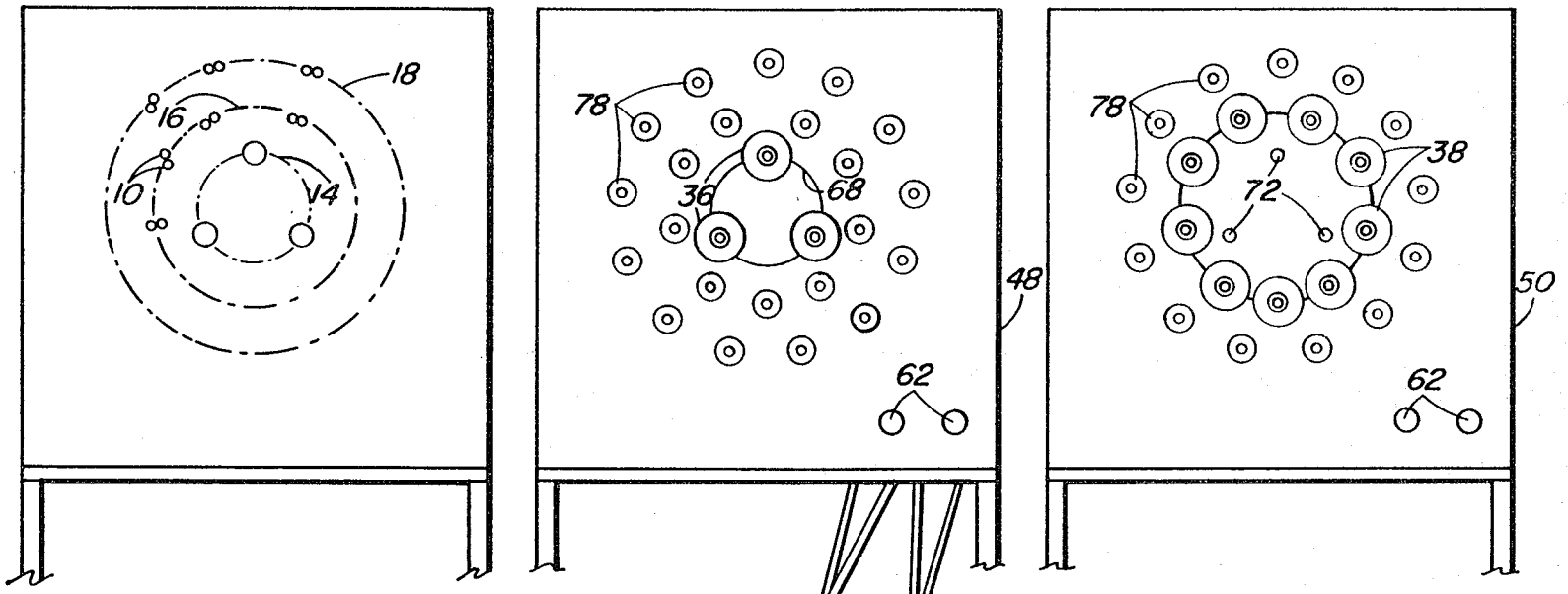
FIG. 2 is a cross-sectional view taken along line II—II in FIG. 1 showing diagramatically the relative positions of guide means for the pairs around a common axis of the apparatus, details of structure of the apparatus being omitted.
FIGS. 3, 4 and 5 are cross-sectional views taken along lines III—III, IV—IV, and V—V respectively in FIG. 1.

The apparatus comprises a plurality of wire guide means for each wire pair. As is shown by FIG. 1, each guide means 10 has a longitudinal axis which extends in the wire pass direction, i.e. from the left to the right in FIG. 1. The twenty-five guide means 10 are disposed in substantially parallel relationship and also extend parallel to a common axis 12 of the apparatus. As is clear from FIGS. 1 and 2, all the guide means are disposed around the common axis 12 and are located upon three pitch circles centered upon the axis 12. In FIG. 2, the guide means 10 are represented, for simplicity, as circles. Three inwardly disposed guide means 10 are equally spaced around an inner pitch circle 14, nine guide means 10 are equally spaced around intermediate pitch circle 16 and the remaining thirteen guide means are equally spaced around an outer pitch circle 18.

As shown by FIG. 1, each guide means is in the form of two guide tubes 20 extending one alongside the other, from a tube support plate 22 at their upstream ends to a twisting station at their downstream ends. Each tube is individually rotatably mounted about its own axis by its upstream end within the plate 22, which is, in turn, spring urged upon parallel guides 24 towards a fixed frame member 26. The tubes are rotatably flexible for the purpose of withstanding the rotational forces involved when downstream ends of the tubes are rotated relative to upstream ends and each at its twisting station, around another longitudinal axis located substantially symmetrically between the tubes. This rotation is alternately in one direction and then in the other from an equilibrium position in which the tubes are untwisted and lie parallel as shown in FIG. 1. The tubes are formed from a material which provides for this rotational flexibility and may be made, for instance, from stainless steel or from an acetal homopolymer, e.g. as sold under the Trademark "DELRIN".

The construction and operation of each guide means and its method of mounting to the frame member 26 are described in patent application Ser. No. 413,179, filed concurrently with this present application in the names of John Nicholas Garner and Jean Marc Roberge and entitled "Stranding Wires". A direction changing means is provided for each twisting means (to be described) as shown by FIG. 1. This changing means 28 comprises a magnetic switch means which is triggered by an interrupter arm as described in copending patent application Ser. No. 413,178, filed concurrently with this present application in the names of John Nicholas Garner, Jean Marc Roberge and Norbert Meilenner and entitled "Apparatus For Stranding Wire". As also described in that specification, each changing means 28 is located a short distance from its associated plate support 22.

Three twisting stations 30, 32 and 34 are provided in the apparatus. All of the guide means 10 have twisting means disposed in one of the three twisting stations. It is convenient for design considerations particularly, that all the guide means disposed on a particular pitch circle 14, 16 or 18 terminate in twisting means disposed at one only of the stations 30, 32 and 34. In this particular apparatus, the three guide means 10 on the pitch circle 14 terminate at a twisting means 36 disposed at twisting station 30. Also, the guide means 10 disposed upon pitch circles 16 and 18, respectively, terminate at twisting means 38 and 40 at the twisting stations 32 and 34.

At each twisting station, a frame means is provided for holding the twisting means. As is clear from FIG. 1, each frame means comprises two frames which are spaced apart along the common axis 12 and each twisting means is carried by both of the frames at its respective twisting station. While FIG. 1 shows only certain of the guide means and twisting means of the apparatus, the illustrations in FIGS. 2 to 5 clearly show the positions of all of the twisting means and guide means of the apparatus.

The tubes of the guide means on the inner pitch circle 14 extend for approximately 65 feet from their tube support plate 22 to the twisting station 30. This distance may of course be greater or smaller, dependent upon design requirements. The other twisting stations 32 and 34 are disposed slightly downstream along the axis 12 from station 30.

Figure 6:
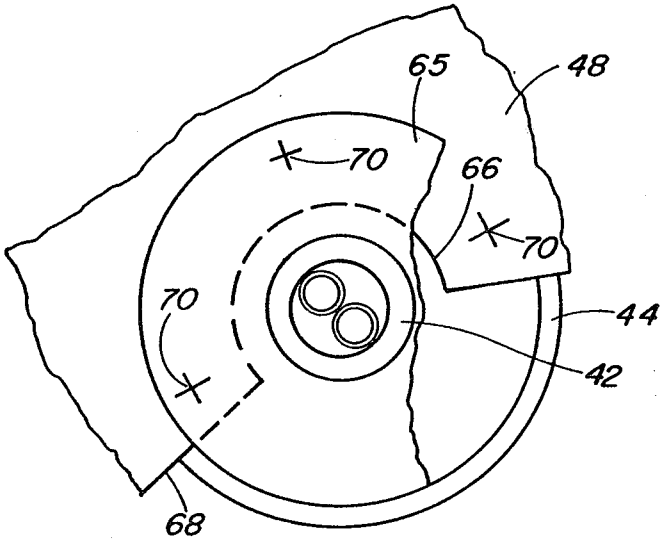
FIG. 6 is a scrap cross-sectional view of the apparatus taken along line VI—VI in FIG. 1 and on a larger scale.
Figure 5:
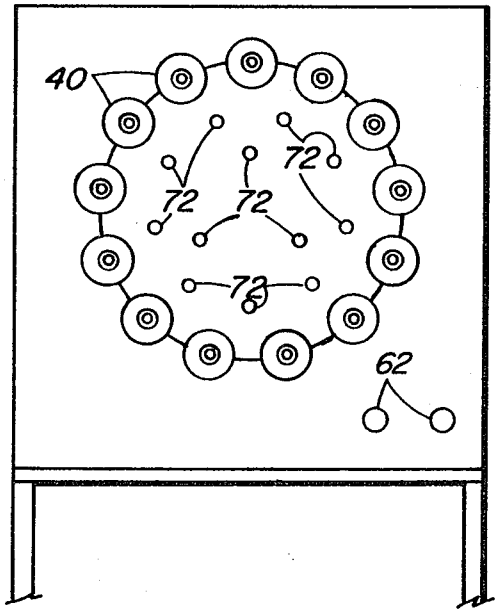

Each twisting means 36, 38 and 40 comprises a cylinder 42 formed with two holes (not shown) within which the downstream ends of its two tubes 20 are secured. Two annular electric clutches 44 and 46 have their driven sides secured to the cylinder 42 for driving it alternately in opposite directions. All clutches 44 and 46 are radially aligned into two groups within the frames 48, 50 and 52 at the stations 30, 32 and 34. The clutches in each group are driven by a common drive belt 54 or 56 and the drive belts at each twisting station are driven continuously, each in one direction around pulley wheels 58 and 60 secured to drive shafts 62 (which are in line in FIG. 1). The drive shafts are driven by a single electric motor 64 (FIGS. 1 and 3). Each twisting means, therefore, comprises a twisting assembly of the two clutches and the associated cylinder 42. This assembly is rotatable within two annular plates 65 which are held to the two frames 48, 50 or 52 by bolts as indicated by positions 70 in FIG. 6. The cylinder 42 of each assembly lies within aligned apertures 66 of its two frames (see FIG. 6), each of the apertures opening into a central hole 68 formed in the frames, whereby the assembly is removable in its assembled state by moving it radially from its apertures 66, into the central hole and then axially away from the frames. FIGS. 3, 4 and 5 show clearly the relative sizes of the central apertures 68 and of the positions of the twisting means around the apertures in each case.

Downstream of each twisting means 36, 38, a separation tube means extends, said means being to prevent the wires of each wire unit from stranding together until they reach a stranding station (to be described). Immediately downstream of each twisting means 36, 38, this separation tube means comprises a single tube 72 which is secured at its upstream end to its cylinder 42 and at its downstream end is rotatably held by a bearing 74, in a frame 76, lying immediately downstream from the twisting station 34. These tubes 72 are torsionally rigid, i.e. as they rotate with their twisting means, they do not torsionally twist as does each guide means. Each tube 72 is formed from metal or rigid plastic. The tubes 72 pass through the central apertures 68 of frames 50 and 52 as they move towards the frame 76 as shown by FIGS. 1, 4 and 5. As is also clear from FIGS. 1, 3 and 4, each guide means 10 terminating at twisting stations 32 and 34, passes through either a clearance hole in each upstream frame 48 or 50 or alternatively, the guide means passes through a bearing 78 in each frame as shown by these figures.

Each of the guide means and tubes 72 leading to the frame 76, or in the case of the guide means terminating in the twisting means 40, is to be used to enable each of its wires 80 to be given a degree of twist by the twisting means while the tubes prevent the wires from twisting together. The pitch circle for the twisting means 40 is at a diameter only sufficient to allow all guide means and twisting means to be passed between and held by the various frames while being suitably drivably connected to the motor 64 without any interference between one twisting means and its guide means and another. Nevertheless, for stranding together twenty-five pairs of wires, the diameter of the outermost pitch circle is approximately 20 inches. However, it is required that the apparatus should provide a cable core unit 82 from these wires. This involves the bringing together of all of the stranded wire units. To prevent the stranded wire units time to develop a significant unstranding action before being formed into the core unit 82, it is essential that a stranding station 84 is immediately at a position upstream of a core unit forming station 86. Hence, some means is required to more closely group the unstranded wires together at the stranding station where stranding into the wire units is then accomplished.

For the above purpose, separation tube means extend downstream beyond frame 52 and 76 and have the properties which will now be discussed to enable them to follow and maintain converging curved paths although they are caused to rotate in alternating directions together with the twisting means. These curved paths direct the twenty-five parallel paths for the wires of the pairs into a single path which is coincident with the axis 12 at the station 86.

As shown by FIG. 1, each separation tube means comprises a wire separation tube 88. In the case of each tube 72 terminating at the frame 76, the paths for the wires of each pair to be stranded are continued by a separation tube 88 which passes through bearings 90 in a support frame 92 and terminates at a support frame 94 which is disposed immediately upstream of the stranding station 84. These tubes 88 are secured to the tubes 72 so as to rotate with them. Wire separation tubes 88 also are secured to and extend from the cylinders 42 of twisting means 40, and these tubes 88 pass through clearance holes (not shown) in the frame 76, which lies close to the cylinders 42, and then proceed through bearings 90 to terminate at frame 94. The tubes converge as they pass through frame 92 to frame 94 and each tube is held upon its curved path by the frames.

Clearly, each tube is required to rotate around its axis which coincides with the fixed curved feedpath section for the wires to be fed through it. Each tube must have sufficient flexibility to be maintained in this curved configuration while enduring alternating compressive and tensile stresses to give a satisfactorily long working life. Each tube 88 also has torsional rigidity to prevent it from twisting thereby avoiding build-up and retention of twist. The tubes 88 of this embodiment are formed from an acetal homopolymer as sold under the trademark "DELRIN" and have an outside diameter of 0.22" and an inside diameter of 0.075". These tubes pass through the frame 92 to frame 94 at pitch circle diameters, which while decreasing, still maintain the relative positions of the tubes at frame 94. Although the outermost pitch circle diameter is reduced from around 20" at frames 76 to approximately 8" over a distance of approximately 20" along the axis 12, the tubes 88 satisfactorily withstand the stresses involved. Another suitable material is stainless steel. The structure of the tubes 88 and the manner in which they are held to the frames 92 and 94 is described in complete detail in U.S. patent application Ser. No. 413,176, in the names of John Nicholas Garner and Jean Marc Roberge, filed concurrently with this present application and entitled "Apparatus For Stranding At Least Two Wires Together".

In use of the apparatus as described above each of the twisting means is rotated continuously in alternating directions for a preset number of revolutions (e.g. 35 revolutions to each side of an untwisted position of the guide tubes as shown by FIG. 1). The downstream end of the associated guide tubes 20 rotate with the twisting means to place torsional twist on the tubes first in one direction and then the other about a longitudinal axis. The alternate rotation of the twisting means is effected by the direction changing means 28 which alternately operates the clutches 44 and 46. The wires 80 are passed through the tubes 20 which prevent the wires from twisting together as the wires move towards the twisting means. The wires pass through the twisting means 36, 38 or 40. Upon the wires for each pair passing through its twisting means 36 and 38, the wires immediately pass from the two tubes 20 into a respective tube 72. These wires then proceed into their separation tubes 88. In each tube 88 the two wires 80 for each pair are fed one on either side of each of two pins in the manner described in application Ser. No. 413,176 referred to above under the title "Apparatus For Stranding At Least Two Wires Together". These pins prevent the wires from stranding together under the action of the twisting means while in the tubes 88. The pins also prevent the wires from stranding together during their movement along the tubes 72 and before reaching the tubes 88. The pins in tubes 88 leading from the twisting means 40 also prevent stranding of the wires in these tubes.

The alternately rotating tubes 88 maintain the converging curved paths of their axes to cause the unstranded wires to issue from the tubes at stranding station 84 and in closely adjacent positions. Pairs of wires then strand together from the action of the twisting means. The stranded wire units then move into a conventional binding head 96 at station 86 to bring them together as core unit 82. Because of the closeness of the stations 84 and 86, there is negligible untwisting of wires of the wire units before the wire units come together in the station 86. Frictional contact between the pairs and the use of a binding tape, resists any unwinding tendency. For this purpose, a conventional spool 98 of tape is provided which wraps tape 100 around the core unit 82 as it emerges from the head.

The above apparatus shows that twenty-five pairs of stranded wires (or wire units) may be formed into a cable core unit after having twist imposed in the wires by the use of alternately rotating twisting means. The particular size of apparatus constructed according to the basic concept described in the embodiment depends upon the numbers of pairs of wires required in the final cable core unit. As can be seen, the apparatus is compact transversely of the feedpath for the wires, i.e. transversely to the axis 12. In this particular case, the diameter of the outermost pitch circle is approximately 20". This renders the apparatus attractive for commercial application.

In a modification of the above embodiment (not shown), each guide means in the form of two tubes 10 is replaced by a guide means comprising a single tube defining a single axial passage which provides at least two side-by-side feedpaths for wire. The passage is shaped to prevent wires from moving across the passage to interchange positions by having a narrow passage region in between wider regions which provide the feed paths. Such guide means is disclosed in copending patent application Ser. No. 413,069, filed concurrently with this patent application in the names of John Nicholas Garner, Jean Marc Roberge and Douglas Baxter entitled "Apparatus For Stranding Wire".

What is claimed is:

1. Apparatus for forming a cable core unit from a plurality of wire units each of at least two stranded together wires comprising:

a plurality of wire guide means, each for the wires of one of the units, each guide means having a longitudinal axis extending in a wire pass direction, being rotationally flexible, and defining individual feedpaths for the two wires of its unit to maintain the wires separate as they proceed to one of at least a first and second twisting stations disposed downstream of the guide means with a second twisting station downstream of the first station;

each guide means terminating at its respective station in a twisting means which is rotatable at its station around the feedpaths of the guide means to effect a rotational twist to the guide means and thus of the feedpaths around the axis;

rotating means to rotate the twisting means in each station and effect rotational twisting of each guide means and its feedpaths for a plurality of revolutions about its axis alternately in one direction and then in the other to introduce and impose an alternating twist in the wires and hold the wires separate as they move towards the twisting means;

a stranding station downstream of the twisting stations with at least a section of the feedpaths for wires of some wire units being curved and of fixed orientation between each twisting station and the stranding station to cause convergence of the feedpaths of wires for each wire unit with the wires for other wire units as they approach the stranding station and to enable the wire units to combine together to form the cable core unit; and separation tube means to prevent the wires for each wire unit from stranding together before they reach the stranding station, said separation tube means being rotatable with the twisting means and extending in curved configuration along the curved feedpath sections, with flexibility to enable the tube means to be maintained in its curved configuration along said fixed path section during rotation of the tube means in said alternating directions and with torsional rigidity to avoid build-up and retention of twist.

2. Apparatus according to claim 1, wherein the wire guide means are disposed around a common axis and the twisting means at one twisting station are disposed outwardly of the common axis from the twisting means at the other station.

3. Apparatus according to claim 2, wherein the outwardly disposed twisting means are disposed around one pitch circle and the inwardly disposed twisting means are disposed around another pitch circle and the wire guide means lie with their longitudinal axis substantially parallel to the common axis as they extend to their respective twisting means.

4. Apparatus according to claim 3, wherein the outwardly disposed twisting means are disposed at the second station and the inwardly disposed twisting means are disposed at the first station.

5. Apparatus according to claim 4, wherein in each of the first and second stations there is disposed a frame means, the wire guide means terminating at the twisting means at the second station by passing through holes formed in the frame means at the first station, and each separation tube means extending from each twisting means at the first station and passing through a clearance hole formed in the frame means at the second station.

6. Apparatus according to claim 5, in which each frame means comprises two frames spaced apart along the common axis and each twisting means is carried by both frames at its respective twisting station.

7. Apparatus according to claim 6, wherein each twisting means comprises two axially aligned clutches alternatively drivably connected to the respective wire guide means to rotate the guide means in opposite directions, each clutch of each twisting means being radially aligned with one clutch of each of the other twisting means disposed at the same station to form a set of aligned clutches, and two endless drive means drivable continuously in opposite directions are drivably connected one to each set of radially aligned clutches.

8. Apparatus according to claim 7, wherein two belts, one belt at each station, are drivably connected to a common drive shaft extending between the frames at the two stations.

9. Apparatus according to claim 6, wherein each twisting means at each station comprises a cylinder surrounding the feedpaths for two wires for a wire unit and two clutches oppositely drivably connected to the cylinder to form a twisting assembly, each twisting assembly extending through two aligned apertures in its support frames, said apertures opening into a central hole formed in the frames whereby the assembly is removable in its assembled state by moving it radially from its aperture and into the central hole and then axially away from the frames.

10. Apparatus according to claim 1, wherein there are a first, second and third twisting stations with the third station disposed downstream of the second station, the wire guide means are disposed around a common axis with their longitudinal axes substantially parallel to the common axis, the twisting means located at each station are disposed around a pitch circle with the pitch circle diameter of the twisting means at the second station being greater than that at the first station and less than that at the third station, frame means at each of the first, second and third stations to carry the respective twisting means, the wire guide means which terminates at the second and third stations, passing through holes formed in the preceding frame means, and each separation tube means extending from each twisting means at the first and second stations, passing through a clearance hole formed in the succeeding frame means.

* * * * *